US011008690B2

(12) United States Patent
Lee et al.

(10) Patent No.: US 11,008,690 B2
(45) Date of Patent: May 18, 2021

(54) LAUNDRY PROCESSING APPARATUS

(71) Applicant: LG ELECTRONICS INC., Seoul (KR)

(72) Inventors: Dongsoo Lee, Seoul (KR); Kyosoon Chae, Seoul (KR); Oshin Kwon, Seoul (KR); Keunjoo Kim, Seoul (KR); Jaeyong Jeong, Seoul (KR); Sangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 165 days.

(21) Appl. No.: 16/071,962

(22) PCT Filed: Jan. 4, 2017

(86) PCT No.: PCT/KR2017/000106
§ 371 (c)(1),
(2) Date: Jul. 23, 2018

(87) PCT Pub. No.: WO2017/126826
PCT Pub. Date: Jul. 27, 2017

(65) Prior Publication Data

US 2019/0032263 A1 Jan. 31, 2019

(30) Foreign Application Priority Data

Jan. 21, 2016 (KR) ..... 10-2016-0007539

(51) Int. Cl.
*D06F 37/00* (2020.01)
*D06F 17/08* (2006.01)
(Continued)

(52) U.S. Cl.
CPC ..... *D06F 17/08* (2013.01); *D06F 17/10* (2013.01); *D06F 37/40* (2013.01); *D06F 39/125* (2013.01); *D06F 23/04* (2013.01); *D06F 31/00* (2013.01)

(58) Field of Classification Search
None
See application file for complete search history.

(56) References Cited

U.S. PATENT DOCUMENTS 5,601,166 A * 2/1997 Beppu ..... D06F 37/00 192/110 B
5,680,780 A * 10/1997 Kim ..... D06F 17/10 68/134
(Continued)

FOREIGN PATENT DOCUMENTS

EP 1621657 8/2011
EP 2392716 12/2011
(Continued)

OTHER PUBLICATIONS

Extended European Search Report in European Application No. 17741592.4, dated Jul. 24, 2019, 9 pages.

*Primary Examiner* — Michael E Barr
*Assistant Examiner* — Jason P Riggleman
(74) *Attorney, Agent, or Firm* — Fish & Richardson P.C.

(57) ABSTRACT

The present invention relates to a laundry processing apparatus comprising: a tub for storing water and provided with an opening for putting in and taking out laundry; a drum, provided in the interior of the tub, for storing the laundry supplied through the opening; an agitator rotatably provided inside the drum; a rotating shaft connected to the agitator by penetrating the tub and drum; a driving part for rotating the rotating shaft; a connecting part having a connecting body fixed to the drum, and a body-penetrating hole which is provided so as to penetrate the connecting body and through which the rotating shaft is inserted; and a power transmission part, provided inside the body-penetrating hole and connecting the rotating shaft and connecting body, for transmitting the driving power provided by the rotating shaft to the connecting body only when the rotating shaft is
(Continued)

rotating in either the clock-wise direction or counter-clock-wise direction.

19 Claims, 4 Drawing Sheets

(51) Int. Cl.

| | |
|---|---|
| ***D06F 37/40*** | (2006.01) |
| ***D06F 17/10*** | (2006.01) |
| ***D06F 39/12*** | (2006.01) |
| *D06F 23/04* | (2006.01) |
| *D06F 31/00* | (2006.01) |

(56) References Cited

U.S. PATENT DOCUMENTS

| | | | | |
|---|---|---|---|---|
| 2005/0189193 | A1 | 9/2005 | Ikeda | |
| 2015/0211164 | A1* | 7/2015 | Kim | D06F 29/00 68/133 |

FOREIGN PATENT DOCUMENTS

| | | |
|---|---|---|
| JP | 1997-117585 | 5/1997 |
| KR | 20080065765 | 7/2008 |
| KR | 20110043906 | 4/2011 |
| KR | 20150090856 | 8/2015 |
| WO | WO2012150539 | 11/2012 |

* cited by examiner

【Fig. 1】
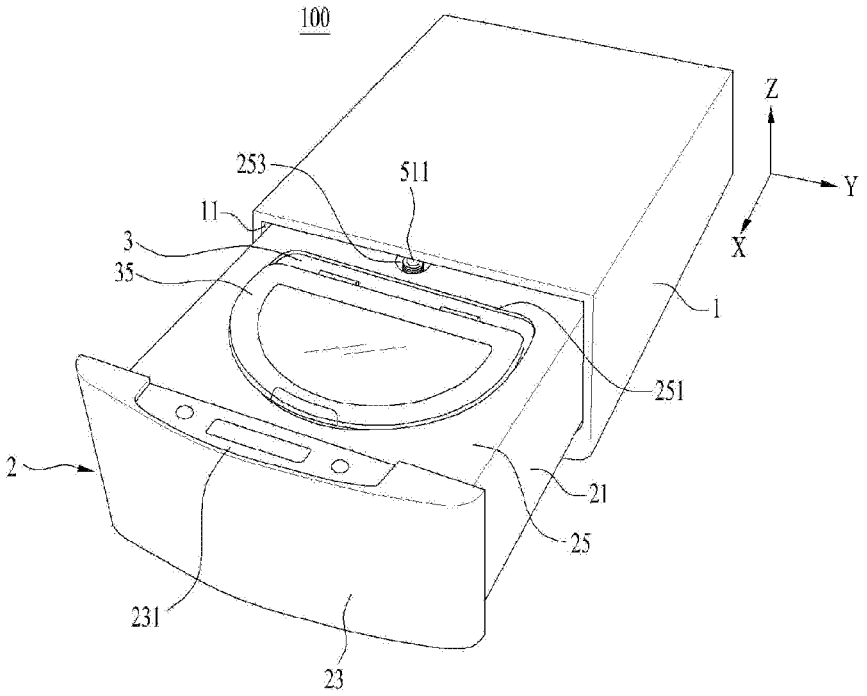
【Fig. 2】
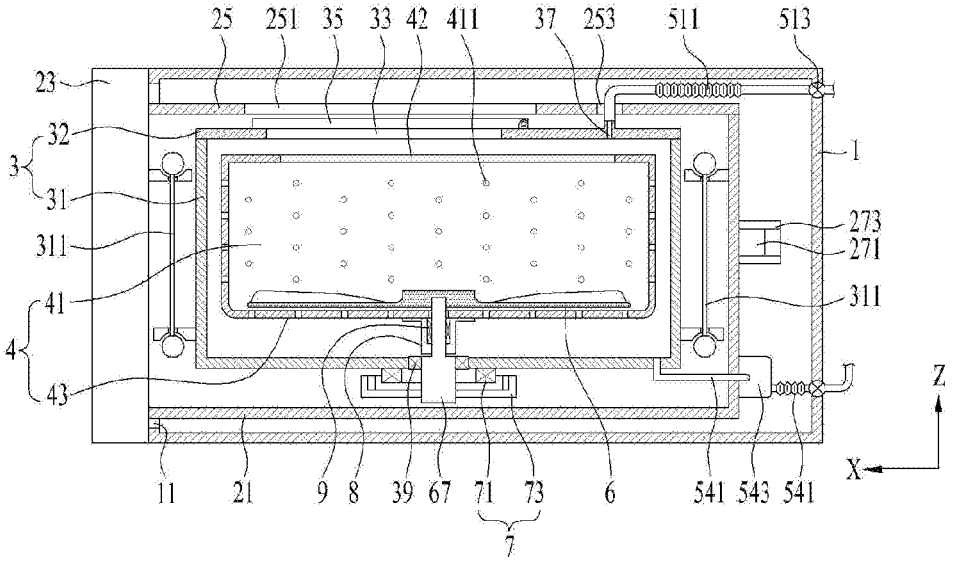

【Fig. 3】
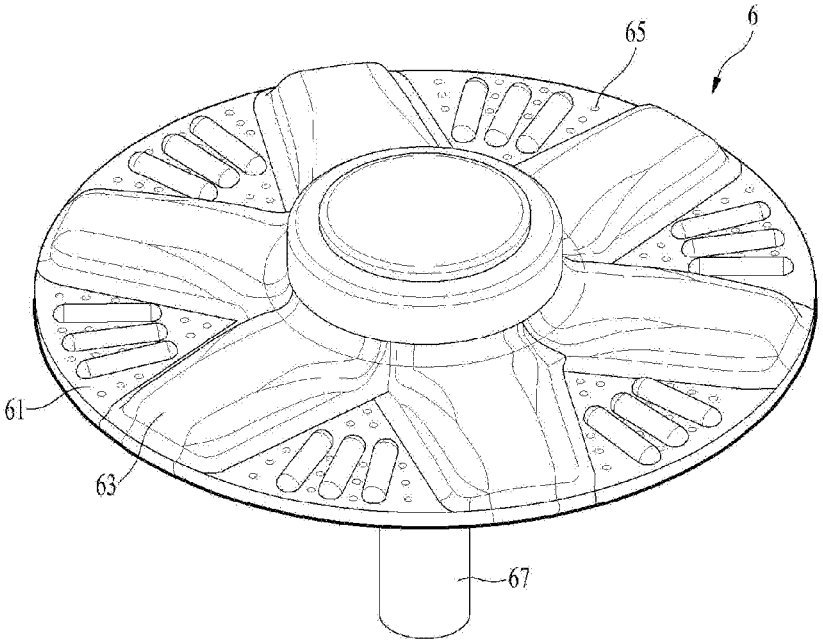

【Fig. 4】
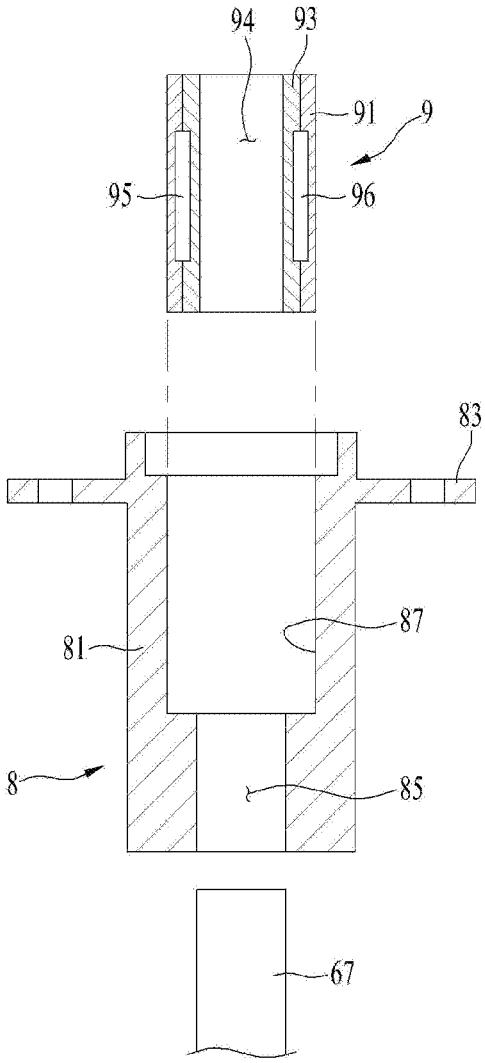

【Fig. 5】
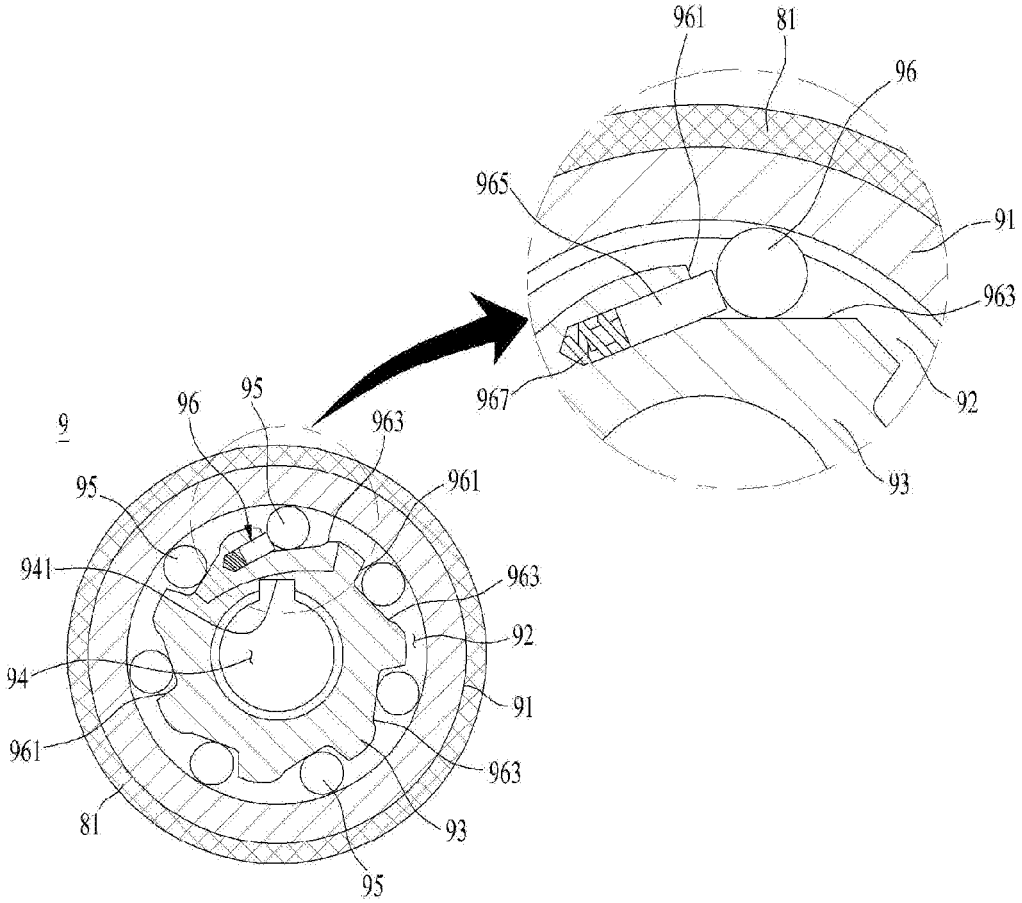

LAUNDRY PROCESSING APPARATUS

CROSS REFERENCE TO RELATED APPLICATIONS

This application is the National Phase of PCT International Application No. PCT/KR2017/000106, filed on Jan. 4, 2017, which claims priority under 35 U.S.C. 1 19(a) to Korean Patent Application No. 10-2016-0007539, filed on Jan. 21, 2016, which is hereby incorporated by reference herein in their entirety.

TECHNICAL FIELD

The present invention relates to a laundry treatment apparatus.

BACKGROUND ART

In general, a laundry treatment apparatus is understood to include an apparatus adapted to wash laundry (objects to be washed or objects to be dried), an apparatus adapted to dry laundry, and an apparatus adapted to perform both washing and drying of laundry.

A laundry treatment apparatus of the related art includes a cabinet, a drawer retractably provided in the cabinet, and an accommodation unit disposed in the drawer to provide a laundry accommodation unit (a laundry treatment space) for washing or drying laundry.

In the laundry treatment apparatus including a laundry accommodation unit that is disposed in a drawer retractably provided in a cabinet, in order to improve the washing performance of the laundry treatment apparatus, the volume of the laundry accommodation unit needs to be increased so that the laundry accommodation unit can contain a larger amount of water and laundry.

Therefore, when designing a laundry treatment apparatus including a laundry accommodation unit disposed in a drawer, it is very important to improve washing performance while minimizing the volume of the laundry accommodation unit.

DISCLOSURE

Technical Problem

An object of the present invention devised to solve the problem lies in a laundry treatment apparatus that is capable of improving washing performance while minimizing the volume thereof.

Another object of the present invention devised to solve the problem lies in a laundry treatment apparatus in which a drum containing laundry and an agitator rotatably provided in the drum are rotated by a single driving unit.

A further object of the present invention devised to solve the problem lies in a laundry treatment apparatus in which only an agitator can be rotated or both an agitator and a drum can be rotated together in the same direction by a single driving unit.

Technical Solution

The objects of the present invention can be achieved by providing a laundry treatment apparatus including a tub for containing water, the tub including an introduction port through which laundry is introduced into or taken out of the tub, a drum provided in the tub, the drum containing the laundry supplied thereto through the introduction port, an agitator rotatably provided in the drum, a rotating shaft penetrating the tub and the drum so as to be connected to the agitator, a driving unit for rotating the rotating shaft, a connecting unit including a connecting body secured to the drum and a body through-hole formed through the connecting body so as to allow the rotating shaft to be inserted thereinto, and a power transmission unit provided in the body through-hole so as to connect the rotating shaft to the connecting body, the power transmission unit being configured to transmit power from the rotating shaft to the connecting body when the rotating shaft rotates only in any one direction selected from among the clockwise direction and the counterclockwise direction.

The power transmission unit may include a first housing secured to the inside of the body through-hole, a housing through-hole formed through the first housing, a second housing rotatably provided in the housing through-hole, a coupling hole formed through the second housing so as to fix the rotating shaft to the second housing, a roller rotatably provided between the housing through-hole and the second housing, and a roller support unit configured to restrict rotation of the roller when the second housing rotates in any one direction selected from among the clockwise direction and the counterclockwise direction.

The roller support unit may include an accommodation portion concavely indented from the outer circumferential surface of the second housing toward the coupling hole so as to define a space for accommodating the roller, a slanted portion protruding from the lower surface of the accommodation portion toward the first housing, and a support unit including one end secured to the second housing and a free end rotatably supporting the roller, the support unit being configured to apply force to the roller so that the roller is pressed toward a space between the housing through-hole and the slanted portion.

The support unit may include a support bar rotatably supporting the roller and an elastic member including one end secured to the second housing and an opposite end secured to the support bar so as to press the support bar toward the roller.

The present invention may further include a cabinet including an entrance formed therein and a drawer to which the tub is secured, the drawer being retractable from the cabinet through the entrance.

The rotating shaft may penetrate the lower surface of the tub and the lower surface of the drum, and may be secured to the agitator.

The rotating shaft may be arranged perpendicular to the ground on which the cabinet is seated.

The driving unit may include a stator secured to the lower surface of the tub while being located outside the tub, the stator being configured to generate a rotating magnetic field, and a rotor configured to be rotated by the rotating magnetic field generated by the stator, wherein the rotating shaft may be secured to the rotor.

The agitator may include a body disposed in the drum so as to be secured to the rotating shaft, the body being formed in the shape of a circular plate, arranged parallel to the lower surface of the drum, and an arm protruding from the body toward the introduction port.

The present invention may further include a communication hole formed through the lower surface of the drum so that the inside of the drum communicates with the inside of the tub therethrough, and an agitator through-hole formed through the body.

Advantageous Effects

The present invention may provide a laundry treatment apparatus that is capable of improving washing performance while minimizing the volume thereof.

In addition, the present invention may provide a laundry treatment apparatus in which a drum containing laundry and an agitator rotatably provided in the drum are rotated by a single driving unit.

In addition, the present invention may provide a laundry treatment apparatus in which only an agitator can be rotated or both an agitator and a drum can be rotated together in the same direction by a single driving unit.

DESCRIPTION OF DRAWINGS

FIGS. 1 and 2 are views illustrating an example of a laundry treatment apparatus according to the present invention.

FIG. 3 is a view illustrating an example of an agitator included in the laundry treatment apparatus according to the present invention.

FIG. 4 is a view illustrating examples of a connecting unit and a power transmission unit included in the laundry treatment apparatus according to the present invention.

FIG. 5 is a view illustrating an example of the power transmission unit included in the laundry treatment apparatus according to the present invention.

BEST MODE

Hereinafter, exemplary embodiments of the present invention will be described in detail with reference to the accompanying drawings. Meanwhile, the configuration of an apparatus or a control method thereof, which will be described below, is merely given to describe the embodiments of the present invention, and is not intended to limit the scope of the present invention. The same reference numerals used throughout the specification refer to the same constituent elements.

As shown in FIG. 1, a laundry treatment apparatus 100 according to the present invention includes a cabinet 1, a drawer 2, which is retractably provided in the cabinet 1, and a laundry accommodation unit 3 and 4, which is disposed in the drawer so as to provide a space required to treat laundry.

The cabinet 1 is provided with an entrance 11, through which the drawer 2 may be drawn out of the cabinet 1 or may be inserted into the cabinet 1. The cabinet 1 may be configured such that the length in the width direction (in the Y-axis direction) is greater than the length in the height direction (in the Z-axis direction) (the drawer may be configured such that the length in the width direction is greater than the length in the height direction).

As shown in FIG. 2, the drawer 2 includes a drawer body 21 having an opening formed in the upper surface thereof, and a drawer cover 25 provided at the opening in the drawer body. That is, the drawer body 21 may be configured to have a hollow hexahedral form, and the drawer cover 25 may be secured to the drawer body 21 so as to define the upper surface of the drawer body 21.

The drawer body 21 may be drawn out of the cabinet 1 or may be inserted into the cabinet 1 using a slider. The slider may include a slider body 271, which is secured to any one of the cabinet 1 and the drawer body 21, and a slider housing 273, which is secured to the remaining one of the cabinet and the drawer body in order to define a moving path of the slider body 271.

The drawer body 21 is provided at the front surface thereof with a drawer panel 23, which serves as means for opening and closing the entrance 11 of the cabinet.

The drawer panel 23 may be provided with a control panel 231 (refer to FIG. 1) for controlling the operation of the laundry treatment apparatus 100. The control panel 231 is provided with a unit (a controller of the laundry treatment apparatus) for controlling units for supplying water to the laundry accommodation unit 3 and 4 and discharging water from the laundry accommodation unit 3 and 4 (a water supply unit and a water discharge unit), a unit for rotating laundry (a driving unit), units for supplying steam or hot air to laundry (a hot air supply unit and a moisture supply unit), and the like.

In addition, the control panel 231 may be provided with an input unit, for enabling a user to input control commands into the laundry treatment apparatus 100, and a display unit (a unit for displaying operational information of the laundry treatment apparatus), for enabling a user to check control commands input through the input unit or notifying a user of the state of execution of the control commands input by the user.

The drawer cover 25 may be provided with a first cover through-hole 251 and a second cover through-hole 253, which are formed through the drawer cover 25 so that the inside of the drawer body 21 communicates with the outside.

The laundry accommodation unit 3 and 4, which is provided in the drawer 2, may include a tub 3, which is provided in the drawer body 21 so as to define a space for containing water, and a drum 4, which is rotatably provided in the tub so as to contain laundry.

The tub 3 may include a tub body 31, which is secured to the inside of the drawer 2 by a tub support unit 311, and a tub cover 32, which defines the upper surface of the tub body.

The tub cover 32 is provided with an introduction port 33, through which the inside of the tub body 31 communicates with the outside of the tub. The introduction port 33 is opened and closed by a door 35.

The door 35 may be hinged to the tub cover 32 (so as to open and close a portion of the tub cover). The door 35 may be rotated toward the outside of the drawer 2 through the first cover through-hole 251 formed in the drawer cover 25. Accordingly, a user may put laundry into the introduction port 33 by opening the door 35 after drawing the drawer 2 out of the cabinet 1.

The tub cover 32 is provided with a water supply hole 37, through which water is introduced into the tub body 31. The water supply hole 37 is connected with one end of a water supply pipe 511, which will be described later.

The drum 4 includes a cylindrical-shaped drum body 41 and communication holes 411, through which the inside of the drum body communicates with the tub. The communication holes 411 may be formed in the circumferential surface and the lower surface 43 of the drum body 41. Accordingly, water contained in the tub body 31 may move into the drum body 41 through the communication holes 411, and water in the drum body 41 may move to the tub body 31 through the communication holes 411.

The drum body 41 is provided at the upper surface thereof with a drum introduction port 42, through which laundry supplied through the introduction port 33 is introduced into the drum body 41.

The reason why the laundry accommodation unit 3 and 4 is composed of the tub 3 and the drum 4 is to enable the laundry treatment apparatus 100 according to the present invention to perform a washing function. Accordingly, in order to enable the laundry treatment apparatus 100 to also perform a function of drying laundry in addition to the washing function, a hot air supply unit (not shown) for supplying hot air to the tub 3 may be further provided in the cabinet 1.

The hot air supply unit (not shown), which is provided in the laundry treatment apparatus 100, may include a circulation duct, for circulating the air in the tub 3, and a heat exchanger, which is provided in the circulation duct in order to dehumidify and heat the air discharged from the tub.

Alternatively, the hot air supply unit (not shown) provided in the laundry treatment apparatus may include a discharge duct for discharging the air in the tub to the outside of the cabinet 1, a supply duct for supplying the air outside the tub 3 to the tub 3, and a heat exchanger for heating the air introduced into the supply duct.

When the laundry treatment apparatus 100 according to the present invention is constructed so as to perform a function of washing laundry, the laundry treatment apparatus 100 needs to further include a water supply unit and a water discharge unit.

The water supply unit may include the water supply pipe 511, which connects a water supply source located outside the cabinet 1 to the water supply hole 37, and a valve 513 for opening and closing the water supply pipe 511 under the control of the controller (not shown).

The water supply pipe 511 penetrates the drawer cover 25 through the second cover through-hole 253. The water supply pipe 511 may be configured to have an extendable structure, or may be made of a flexible material in consideration of the moving range of the drawer.

The water discharge unit serves to discharge the water contained in the tub 3 to the outside of the cabinet 1. The water discharge unit may include a water discharge pipe 541 for guiding the water in the tub 3 to the outside of the cabinet 1, and a pump 543, which is disposed in the water discharge pipe 541 in order to discharge the water in the tub 3. The water discharge pipe may also be configured to have an extendable structure, or may be made of a flexible material.

In order to minimize the volume of the laundry treatment apparatus 100 having the above-described configuration, the volume of the laundry accommodation unit 3 and 4 needs to be minimized. However, a reduction in the volume of the laundry accommodation unit 3 and 4 may reduce the amount of water that the tub 3 can contain, and thus may degrade washing performance.

In order to solve this problem, the laundry treatment apparatus 100 according to the present invention may further include an agitator 6, which is rotatably provided in the drum 4.

As shown in FIG. 3, the agitator 6 serves to agitate laundry supplied to the drum body 41. The agitator 6 may include a body 61 disposed in the drum and arms 63 protruding toward the drum introduction port 42 from the body 61.

The body 61 may be formed in the shape of a circular plate that is parallel to the lower surface 43 of the drum, and the arms 63 may be arranged radially about the rotation center of the body 61.

The body 61 is configured to rotate about a rotating shaft 67. As shown in FIG. 2, the rotating shaft 67 may penetrate the lower surface of the tub and the lower surface 43 of the drum, and may be secured to the body 61. The rotating shaft 67 may be arranged perpendicular to the ground (perpendicular to the lower surface of the cabinet).

In this case, a bearing 39 may also be provided at the lower surface of the tub in order to rotatably support the circumferential surface of the rotating shaft 67.

As shown in FIG. 3, the agitator 6 may further include agitator through-holes 65, which are formed through the body 61. When the body 61 of the agitator is configured as a plate that is parallel to the lower surface 43 of the drum, the body 61 may interrupt the movement of water that is discharged to the tub 3 through the lower surface 43 of the drum or the movement of water that is introduced through the lower surface 43 of the drum from the tub. This problem may be prevented by the agitator through-holes 65.

The drum 4 and the agitator 6 having the above-described configurations may be rotated simultaneously in the same direction, or only the agitator 6 may be rotated by a driving unit 7, a connecting unit 8 and a power transmission unit 9.

As shown in FIG. 2, the driving unit 7 may include a stator 71, which is secured to the tub in order to generate a rotating magnetic field, and a rotor 73, which is configured to be rotated by the rotating magnetic field generated by the stator.

The stator 71 is secured to the lower surface of the tub body 31 and is located outside the tub body 31, and the rotating shaft 67 is secured to the rotor 73.

Unlike the configuration illustrated in FIG. 2, the driving unit 7 may include a driven pulley, which is secured to the rotating shaft 67 and is located outside the tub 3, a motor, which is secured to a location outside the tub 3, a driving pulley, which is configured to be rotated by a rotating shaft of the motor, and a belt, which connects the driving pulley to the driven pulley.

When the driving unit 7 is formed to have the configuration illustrated in FIG. 2, it may be possible to minimize power loss (improve washing performance), which may occur during the power transmission process, in comparison with the mechanism in which the power from the motor is transmitted via the driving pulley, the driven pulley and the belt.

As shown in FIG. 4, the connecting unit 8 includes a connecting body 81, which is secured to the lower surface 43 of the drum, and a body through-hole 85, which is formed through the connecting body 81 so as to define a space into which the rotating shaft 67 is inserted.

The connecting body 81 serves to form the rotating shaft of the drum 4. The connecting body 81 may be provided at the circumferential surface thereof with a coupling portion 83, which is secured to the lower surface 43 of the drum.

The power transmission unit 9 is provided in the body through-hole 85, and serves to connect the rotating shaft 67 to the connecting body 81. The power transmission unit 9 is configured to transmit the rotational force of the rotating shaft 67 to the connecting body 81 when the rotating shaft 67 rotates only in any one direction selected from among the clockwise direction and the counterclockwise direction.

The power transmission unit 9 may be disposed in a receiving portion 87, which is formed in the connecting body 81. The receiving portion 87 may be formed so as to be concentric with the body through-hole 85 and to have a larger diameter than the body through-hole 85.

As shown in FIG. 5, the power transmission unit 9 may include a first housing 91, which is secured to the receiving portion 87, a housing through-hole 92, which is formed through the first housing 91, a second housing 93, which is disposed in the housing through-hole 92, a coupling hole 94, which is formed through the second housing 93 and to which the rotating shaft 67 is secured, a roller 95, which is disposed between the housing through-hole 92 and the second housing 93, and a roller support unit 96, which rotatably supports the roller 95 and allows the roller 95 to rotate when the second housing 93 rotates only in any one direction selected from among the clockwise direction and the counterclockwise direction.

The first housing 91 may be formed in the shape of a ring, which is provided in the center thereof with the housing through-hole 92, and the second housing 93 may be formed in the shape of a ring, which is provided in the center thereof with the coupling hole 94.

In order to couple the rotating shaft 67 to the coupling hole 94, the rotating shaft 67 may be provided with a protrusion (not shown) extending in the longitudinal direction thereof, and the coupling hole 94 may be provided with a protrusion-receiving recess 941 in which the protrusion is received.

The roller 95 serves to support the second housing 93 so that the second housing 93 is rotatable within the housing through-hole 92. The roller 95 is provided so as to be in contact with the outer circumferential surface of the second housing 93 and the housing through-hole 92. The roller 95 may be formed in any shape, as long as it can realize the above-described function.

The roller support unit 96 may include an accommodation portion 961, which is provided at the second housing 93 so as to define a space for accommodating the roller 95, a slanted portion 963, which protrudes from the lower surface of the accommodation portion 961 toward the first housing 91, and a support unit 965 and 967, which has one end secured to the second housing 93 and a free end rotatably supporting the roller 95.

The accommodation portion 961 may be formed such that the outer circumferential surface of the second housing 93 is concavely indented toward the coupling hole 94.

The support unit serves to apply force to the roller 95 so that the roller 95 is pressed toward the housing through-hole 92. The support unit may include a support bar 965 rotatably supporting the roller 95 and an elastic member 967 disposed between the second housing 93 and the support bar 965 in order to apply elastic force to the roller 95.

The elastic member 967 serves to press the support bar 965 so that the roller 95 may be kept in contact with the housing through-hole 92. The elastic member 967 may be, for example, a spring.

The laundry treatment apparatus 100 having the above-described configuration is capable of rotating only the agitator 6 or rotating both the agitator 6 and the drum 4 using the single driving unit 7 through the following process.

Referring to FIG. 5, when electric current forming a magnetic field for realizing clockwise rotation is supplied to the stator 71, the rotor 73 and the rotating shaft 67 may be rotated in the clockwise direction.

When the rotating shaft 67 is rotated in the clockwise direction, the agitator 6 secured to the rotating shaft may also be rotated in the clockwise direction within the drum 4. Accordingly, the laundry contained in the drum 4 may be agitated within the drum by the agitator 6. Therefore, the agitator 6 may provide frictional force to the laundry, leading to improvement of the washing performance of the laundry treatment apparatus according to the present invention.

When the agitator 6 is rotated by the clockwise rotation of the rotating shaft 67, the drum 4 is not rotated. The roller support unit 96 presses the roller 95 toward the housing through-hole 92 so that the surface of the roller 95 is kept in contact with the accommodation portion 961 and the housing through-hole 92. In this state, when the rotating shaft 67 is rotated in the clockwise direction, the roller 95 is rotated within the accommodation portion 961, and thus the rotational force of the second housing 93 is not transmitted to the first housing 91.

Conversely, when electric current forming a magnetic field for realizing counterclockwise rotation is supplied to the stator 71, both the agitator 6 and the drum 4 may be rotated in the counterclockwise direction.

When a magnetic field for realizing counterclockwise direction is formed by the stator 71, the rotor 73 and the rotating shaft 67 secured to the rotor are rotated in the counterclockwise direction. Accordingly, the agitator 6 secured to the rotating shaft 67 may be rotated in the counterclockwise direction within the drum 4.

When the rotating shaft 67 is rotated in the counterclockwise direction, the second housing 93 may also be rotated in the counterclockwise direction.

When the second housing 93 is rotated in the counterclockwise direction, the roller 95 may be located in the space between the slanted portion 963 and the housing through-hole 92, which is smaller than the space between the accommodation portion 961 and the housing through-hole 92, by the roller support unit 96.

When the roller 95 is located in the space between the slanted portion 963 and the housing through-hole 92, the roller 95 is prevented from rotating by the frictional force between the slanted portion 963 and the roller 95 and by the friction force between the roller 95 and the housing through-hole 92.

In the state in which the roller 95 is prevented from rotating, the first housing 91 may be rotated together with the second housing 93.

When the first housing 91 is rotated with the second housing 93 in the counterclockwise direction, the connecting body 81 secured to the first housing 91 may also be rotated in the counterclockwise direction, and thus the drum 4 coupled to the connecting body 81 may also be rotated in the counterclockwise direction within the tub 3.

Accordingly, the present invention is capable of rotating only the agitator 6 or rotating both the agitator 6 and the drum 4 merely using the single driving unit 7.

The process of rotating only the agitator 6 may be utilized for the process of removing foreign substances from laundry after supplying water to the tub through the water supply unit 511 and 513. The process of rotating both the agitator 6 and the drum 4 in the same direction may be utilized for the process of separating foreign substances from laundry and the process of removing water from the laundry.

That is, the laundry treatment apparatus 100 according to the present invention may be controlled so as to perform a water supply step of supplying water to the tub through the water supply unit, a step of separating foreign substances from laundry by rotating only the agitator 6 or by rotating both the agitator 6 and the drum 4, a water discharge step of discharging water contained in the tub to the outside of the tub through the water discharge unit 541 and 543, and a step of separating water from the laundry by rotating both the agitator 6 and the drum 4.

The process of removing foreign substances from laundry may include a first step of rotating only the agitator 6 by rotating the rotating shaft 67 in any one direction selected from among the clockwise direction and the counterclockwise direction, and a second step of rotating both the agitator 6 and the drum 4 by rotating the rotating shaft 67 in the remaining one direction selected from among the clockwise direction and the counterclockwise direction.

The step of removing water and foreign substances from the laundry may include a step of rotating both the agitator 6 and the drum 4 by rotating the rotating shaft 67 in the remaining one direction selected from among the clockwise direction and the counterclockwise direction, like the above-described second step.

Although the configurations or functions of the driving unit 7, the connecting unit 8 and the power transmission unit 9 have been described above with reference to the configuration in which the tub is disposed in the drawer retractably provided in the cabinet, the driving unit, the connecting unit and the power transmission unit may also be applied to a laundry treatment apparatus not including the drawer.

That is, the driving unit 7, the connecting unit 8 and the power transmission unit 9 may also be applied to a laundry treatment apparatus including a cabinet, a tub secured to the inside of the cabinet, and a drum rotatably provided in the tub.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:
- a tub configured to receive water, the tub defining an introduction port that allows introduction of laundry into the tub and withdrawal of laundry from the tub;
- a drum located in the tub and configured to receive laundry through the introduction port;
- an agitator located in the drum and configured to rotate relative to the drum;
- a rotating shaft that penetrates the tub and the drum and that connects to the agitator through the tub and the drum;
- a driving unit connected to the rotating shaft and configured to rotate the rotating shaft;
- a connecting unit comprising a connecting body coupled to a bottom of the drum, the connecting body having a body through-hole that penetrates the connecting body; and
- a power transmission unit disposed in the body through-hole and connected to the rotating shaft and the connecting body,
- wherein the power transmission unit comprises:
  - a first housing disposed in the body through-hole and fixed to the connecting unit, the connecting unit being configured to rotate with the first housing,
  - a second housing that is rotatably provided in the first housing and that has a coupling hole receiving the rotating shaft, the second housing being configured to be rotated by the rotating shaft,
  - a roller rotatably provided between the first housing and the second housing, and
  - a roller support unit provided in the second housing and configured to press the roller in a predefined direction based on the second housing rotating in a first direction,
- wherein the first housing is configured to contact and be rotated by the roller that is pressed by the roller support unit based on the second housing rotating in the first direction, and
- wherein the connecting unit and the power transmission unit are disposed between the bottom of the drum and a bottom of the tub.

2. The laundry treatment apparatus according to claim 1, wherein the roller support unit comprises:
- an accommodation portion that is recessed from an outer circumferential surface of the second housing toward the coupling hole and that defines a space configured to accommodate the roller;
- a slanted portion that extends from a lower surface of the accommodation portion toward the first housing; and
- a support unit comprising a first end coupled to the second housing and a second end configured to rotatably support the roller, the support unit being configured to apply pressure to the roller toward a space defined between the slanted portion and an inner surface of the first housing, and
- wherein the roller support unit is configured to restrict rotation of the roller based on the second housing rotating in one of a clockwise direction or a counterclockwise direction.

3. The laundry treatment apparatus according to claim 2, wherein the support unit comprises:
- a support bar configured to rotatably support the roller; and
- an elastic member comprising a first end coupled to the second housing and a second end coupled to the support bar, the elastic member being configured to push the support bar toward the roller.

4. The laundry treatment apparatus according to claim 1, further comprising:
- a cabinet that defines an entrance; and
- a drawer configured to receive the tub and configured to insert into and retract from the cabinet through the entrance.

5. The laundry treatment apparatus according to claim 4, wherein the rotating shaft penetrates a lower surface of the tub and a lower surface of the drum to couple to the agitator.

6. The laundry treatment apparatus according to claim 5, wherein the rotating shaft extends in a direction perpendicular to a bottom surface of the cabinet.

7. The laundry treatment apparatus according to claim 5, wherein the driving unit comprises:
- a stator located outside of the tub and coupled to the lower surface of the tub, the stator being configured to generate rotating magnetic field; and
- a rotor configured to rotate based on rotating magnetic field generated by the stator, and
- wherein the rotating shaft is coupled to the rotor.

8. The laundry treatment apparatus according to claim 5, wherein the agitator comprises:
- a body located in the drum and coupled to the rotating shaft, the body having a circular plate shape arranged parallel to the lower surface of the drum; and
- an arm that protrudes from the body toward the introduction port.

9. The laundry treatment apparatus according to claim 8, wherein the lower surface of the drum defines a communication hole that enables communication between an inside of the drum and an inside of the tub, and
- wherein the body of the agitator defines an agitator through-hole that extends through the body of the agitator.

10. The laundry treatment apparatus according to claim 1, wherein the rotating shaft comprises a protrusion that extends in a longitudinal direction of the rotating shaft, and
- wherein the second housing further defines a protrusion-receiving recess that is configured to receive the protrusion of the rotating shaft and that is recessed from an inner surface of the second housing that defines the coupling hole.

11. The laundry treatment apparatus according to claim 1, wherein the connecting body further defines a receiving portion that is concentric with the body through-hole, wherein a diameter of the receiving portion is greater than a diameter of the body through-hole, and wherein the first housing is configured to couple to the receiving portion.

12. The laundry treatment apparatus according to claim 11, wherein the receiving portion extends from the body through-hole.

13. The laundry treatment apparatus according to claim 1, wherein the connecting body is coupled and fixed to a lower surface of the drum.

14. The laundry treatment apparatus according to claim 1, wherein the roller has a cylindrical shape that extends in a longitudinal direction of the rotating shaft.

15. The laundry treatment apparatus according to claim 1, wherein the roller comprises a plurality of rollers arranged about the coupling hole.

16. The laundry treatment apparatus according to claim 15, wherein the second housing defines a plurality of accommodation portions that are recessed from an outer circumferential surface of the second housing toward the coupling hole, each accommodation portion being configured to accommodate one of the plurality of rollers.

17. The laundry treatment apparatus according to claim 2, wherein a first distance from the lower surface of the accommodation portion to the inner surface of the first housing is greater than a second distance from an end of the slanted portion to the inner surface of the first housing.

18. The laundry treatment apparatus according to claim 17, wherein a diameter of the roller is less than or equal to the first distance and greater than the second distance.

19. The laundry treatment apparatus according to claim 3, wherein the support bar is configured to, based on pressure applied by the elastic member, maintain the roller to contact the inner surface of the first housing.

* * * * *